US006051932A

United States Patent [19]

Sheu et al.

[11] Patent Number: 6,051,932

[45] Date of Patent: Apr. 18, 2000

[54] LOW POWER DISSIPATION VACUUM FLUORESCENT DISPLAY

[75] Inventors: Liang-Kuei Sheu, Chiayei; Lai-Cheng Chen, Taipei; Lyuji Ozawa, Hsinchu, all of Taiwan

[73] Assignee: Industrial Technology Research Institute, Hsin-Chu Hsien, Taiwan

[21] Appl. No.: 09/158,350

[22] Filed: Sep. 21, 1998

[51] Int. Cl.[7] ..... G09G 3/10

[52] U.S. Cl. ..... 315/169.3; 315/169.1; 315/291

[58] Field of Search ..... 315/169.3, 174, 315/169.1, 246, 315, 128, 362, 291, 307

[56] References Cited

U.S. PATENT DOCUMENTS 5,949,194 9/1999 Kawakami et al. ..... 315/169.3

5,952,788 9/1999 Graham et al. ..... 315/169.1

*Primary Examiner*—Don Wong

*Assistant Examiner*—Thuy Vinh Tran

*Attorney, Agent, or Firm*—Harness, Dickey & Pierce, P.L.C.

[57] ABSTRACT

A vacuum fluorescent display comprises a plurality of filaments or filament sets, a controller, and a display portion. The controller controls one of the filaments or filament sets to be alternately connected to a power supply so as to emanate electrons as an electron source. Thus, a predetermined pattern can be displayed on the display portion in response to the electrons. The fact that the filaments or filament sets are alternately powered to induce hot-electron emanation can reduce the overall power consumption for the vacuum fluorescent display.

19 Claims, 2 Drawing Sheets

LOW POWER DISSIPATION VACUUM FLUORESCENT DISPLAY

BACKGROUND OF THE INVENTION

1. Field of the Invention

The present invention relates to a vacuum fluorescent display. More particularly, the present invention relates to a power-economy vacuum fluorescent display which alternately powers filaments to emanate electrons therefrom in the manner of a scanning operation and thus reduces the overall power dissipation.

2. Description of the Related Art

With the characteristics of bright-color and great brightness, vacuum fluorescent displays have been widely applied to household appliance indicator panels and automobile instrument panels as well. Referring to FIG. 1, a schematic diagram of a vacuum fluorescent display is depicted. The operation of the vacuum fluorescent display will be described in conjunction with FIG. 1 as follows.

As shown in FIG. 1, reference numeral 1 designates a filament which is connected to and powered by a DC or AC power supply for inducing hot-electron emanation as an electron source. Although only one filament 1 is illustrated, a plurality of filaments should be provided for furnishing sufficient electrons. Reference numeral 2 designates a grid generally powered by a positive voltage to accelerate the generated electrons and confine their progress paths within a predetermined range. Reference numeral 3 represents a display portion, which comprises seven segmented anodes 3A, 3B, 3C, 3D, 3E, 3F, and 3G as shown in FIG. 1. These anodes 3A–3G, with a fluorescent material coated thereon, will emit fluorescent light when electrons collide with the surface of the anodes 3A–3G. Reference numeral 4 designates a plurality of data lines connected to the respective segmented anode 3A, 3B, 3C, 3D, 3E, 3F, or 3G. If any anode 3A, 3B, 3C, 3D, 3E, 3F, or 3G is desired to emit fluorescent light, a positive voltage is applied to the corresponding data line 4. To the contrary, a negative voltage will be applied to the corresponding data line 4 when the controlled anode 3A, 3B, 3C, 3D, 3E, 3F, or 3G is not intended to emit fluorescent light. For example, to display a digit "3", the anodes 3B, 3C, 3D, 3F, and 3G are powered by positive voltages while the anodes 3A and 3E are powered by negative voltages, through the associated data lines 4.

Typically, of the vacuum fluorescent display simultaneously powers every filament at all time during operation, which is estimated to consume three-fourth of overall power dissipation. While power dissipation is not so much of an issue in the application of vacuum fluorescent displays to household appliance indicator panels and automobile instrument panels, low power consumption can offer better competitiveness and also adhere to the current trend towards energy resource conservation. Moreover, in the application of vacuum fluorescent displays to portable products such as cellular phones, high power dissipation consumed by the filaments is unfavorable.

SUMMARY OF THE INVENTION

It is therefore an object of the present invention to provide a low power dissipation vacuum fluorescent display comprising a plurality of filaments alternately powered to emanate electrons for economizing the overall power consumption.

The present invention achieves the above-indicated objects by providing a vacuum fluorescent display which comprises a plurality of filaments/filament sets, a controller, and a display portion. The controller alternately connects one of the filaments/filament sets with a power supply to generate electrons, and the display portion displays a pattern in response to the generated electrons.

Therefore, according to the present invention, the filaments or filament sets alternately powered to induce hot-electron emanation can reduce the overall power consumption for the vacuum fluorescent displays.

BRIEF DESCRIPTION OF DRAWINGS

The following detailed description, given by way of examples and not intended to limit the invention to the embodiments described herein, will best be understood in conjunction with the accompanying drawings, in which.

DETAILED DESCRIPTION OF THE INVENTION

According to the present invention, a vacuum fluorescent display comprises a plurality of filaments or filament sets, a controller, and a display portion. The controller controls one of the filaments or filament sets to be alternately connected to a power supply so as to emanate electrons as an electron source. Thus, a predetermined pattern can be displayed on the display portion in response to the electrons. The fact that the filaments or filament sets are alternately powered to induce hot-electron emanation can reduce the overall power consumption for the vacuum fluorescent displays.

Figure 2:
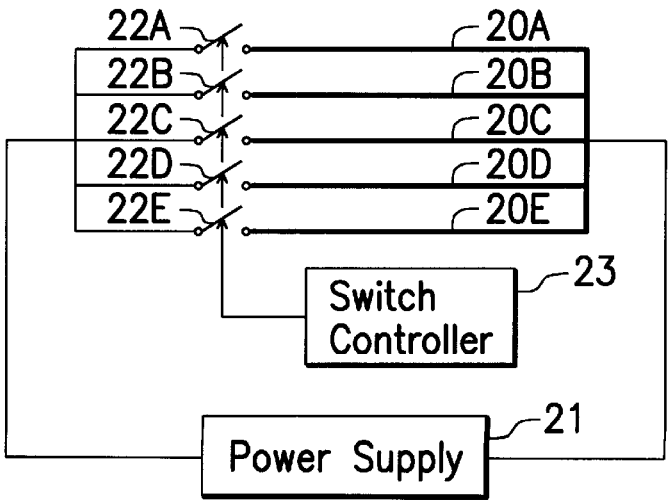
FIG. 2 depicts a schematic diagram of one preferred embodiment in accordance with the present invention.

Referring to FIG. 2, a schematic diagram of one preferred embodiment in accordance with the present invention is depicted. Reference numerals 20A–20E designate a plurality of filaments, five of which are exemplified in FIG. 2, though the scope of the present invention is not limited to that exact amount. Preferably, the filaments 20A–20E are so arranged to be spaced apart from each other in parallel and are powered by a DC or AC power supply 21. Each switch 22A, 22B, 22C, 22D, or 22E is connected between the respective filaments 20A, 20B, 20C, 20D, or 20E and the power supply 21, thereby controlling whether or not the power supply 21 can provide a voltage or a current to the filaments 20A–20E, respectively. In other words, a given filament 20A, 20B, 20C, 20D, or 20E is powered by the power supply 21 when the respective switch 22A, 22B, 22C, 22D, or 22E is closed, and a given filament 20A, 20B, 20C, 20D, or 20E is disconnected from the power supply 21 when the respective switch 22A, 22B, 22C, 22D, or 22E is open. However, the switching state of those switches 22A–22E is determined by a switch controller 23.

According to the present invention, the switch controller 23 alternately turns on the switches 22A–22E so that the respective filaments 20A–20E can be alternately powered by the power supply 21. Therefore, for a specified period only one of the filaments 20A–20E is powered to conduct a current flow and thus induce hot-electron emanation. In addition, some material such as calcium oxide, strontium oxide, or barium oxide can be coated onto the surface of the filaments 20A–20E to increase the efficiency of the hot-electron emanation. Preferably, the switch controller 23 can alternately turn on the switches 22A–22E in the manner of a scanning operation, for example, by means of a pulse signal with a frequency greater than 40 Hz and a duty cycle greater than 8%. Basically, each filament 20A, 20B, 20C, 20D, or 20E should be powered by the power supply 21 when the corresponding part of the display portion 3 is desired to display. Consequently, the aforementioned scanning method can be optimized based upon the spatial relationship between the filaments 20A–20E and the display portion 3.

Figure 3:
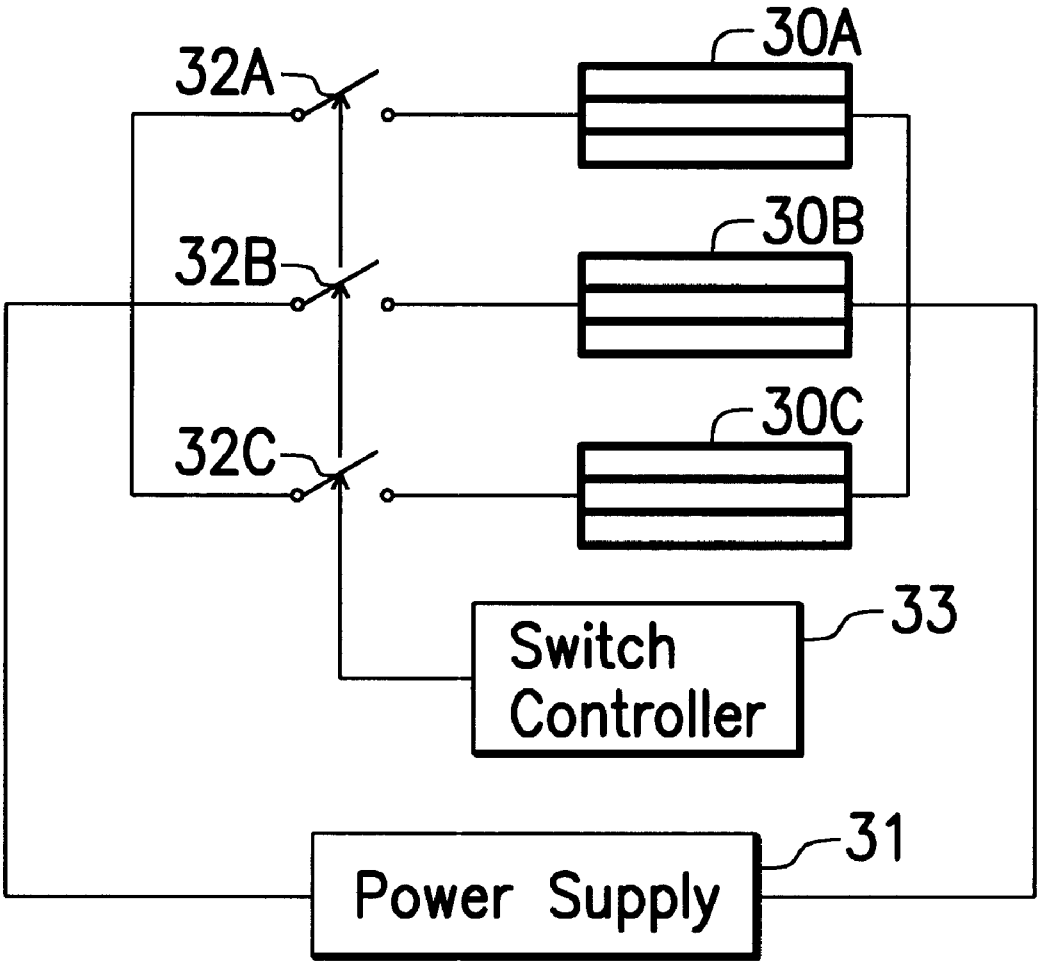
FIG. 3 depicts a schematic diagram of another preferred embodiment in accordance with the present invention.

Referring to FIG. 3, a schematic diagram of another preferred embodiment in accordance with the present invention is depicted. Reference numerals 30A–30C designate a plurality of filament sets, three of which are exemplified in FIG. 3, though the scope of the present invention is not limited to that exact amount. Each filament set 30A, 30B, or 30C comprises a plurality of filaments, four of which are exemplified in FIG. 3. Preferably, those filament sets 30A–30C are so arranged to be spaced apart from each other in parallel and are powered by a DC or AC power supply 31. Each switch 32A, 32B, or 32C, is connected between the respective filament set 30A, 30B, or 30C and the power supply 21, thereby controlling whether or not the power supply 31 can provide a voltage or a current to the filament sets 30A–30C, respectively. In other words, a given filament set 30A, 30B, or 30C is powered by the power supply 31 when the respective switch 32A, 32B, or 32C is closed, and a given filament set 30A, 30B, or 30C is disconnected from the power supply 21 when the respective switch 32A, 32B, or 32C is open. However, the switching state of those switches 32A–32C is determined by a switch controller 33.

According to the present invention, the switch controller 33 alternately turns on the switches 32A–32C so that the respective filament sets 30A–30C can be alternately powered by the power supply 31. Therefore, for a specified period only one of the filament sets 30A–30C is powered to conduct a current flow and thus induce hot-electron emanation. In addition, some material such as calcium oxide, strontium oxide, or barium oxide can be coated onto the surface of the filaments to increase the efficiency of the hot-electron emanation. Preferably, the switch controller 33 can alternately turn on the switches 32A–32C in the manner of a scanning operation, for example, by means of a pulse signal with a frequency greater than 40 Hz and a duty cycle greater than 8%. Basically, each filament set 30A, 30B, or 30C should be powered by the power supply 31 when the corresponding part of the display portion 3 is desired to display. Consequently, the aforementioned scanning method can be optimized based upon the spatial relationship between the filament sets 30A–30C and the display portion 3.

Figure 1:
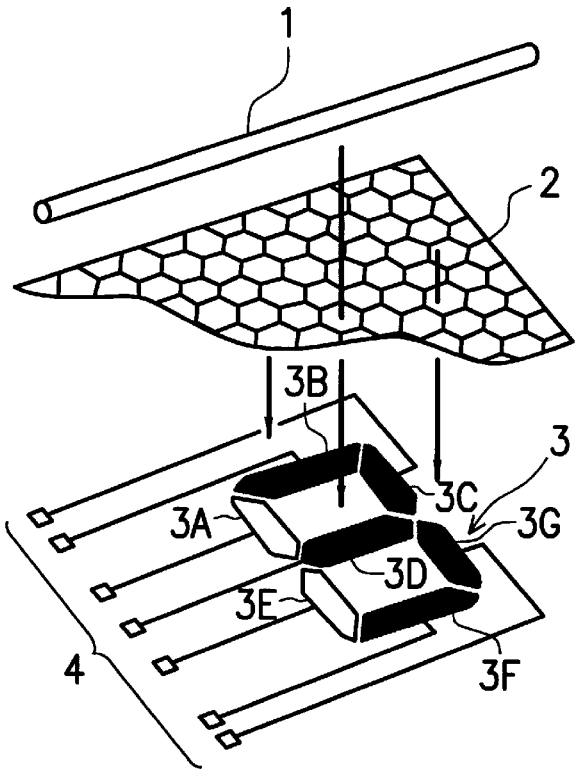
FIG. 1 depicts a schematic diagram of a vacuum fluorescent display.

Furthermore, the vacuum fluorescent display according to the present invention comprises the grid 2 and the display portion 3 as illustrated in FIG. 1. The grid 2 is generally powered by a positive voltage to accelerate the generated electrons and confine their progress paths within a predetermined range. The display portion 3 comprises several anodes configured with segments, dot-matrix, or pixels based upon the type of display, e.g., segment displays, dot-matrix displays, or graphic displays. In FIG. 1, the display portion 3 comprises seven segmented anodes 3A, 3B, 3C, 3D, 3E, 3F, and 3G, with a fluorescent material coated thereon for emitting fluorescent light when electrons collide with the surface of the anodes 3A–3G.

Reference numeral 4 designates a plurality of data lines connected to the respective segmented anode 3A, 3B, 3C, 3D, 3E, 3F, or 3G. If any anode 3A, 3B, 3C, 3D, 3E, 3F, or 3G is desired to emit fluorescent light, a positive voltage is applied to the corresponding data line 4. To the contrary, a negative voltage will be applied to the corresponding data line 4 when the controlled anode 3A, 3B, 3C, 3D, 3E, 3F, or 3G is not intended to emit fluorescent light. For example, for displaying a digit "3", the anodes 3B, 3C, 3D, 3F, and 3G are powered by positive voltages while the anodes 3A and 3E are powered by negative voltages, through the associated data lines 4.

Moreover, according to the present invention, the vacuum fluorescent display can make image-flashing effects by either controlling the data lines 4 or scanning the filaments or filament sets.

In conclusion, according to the present invention, the vacuum fluorescent display comprises a plurality of filaments or filament sets, a controller, and a display portion. The controller controls one of the filaments or filament sets to be alternately connected to a power supply so as to emanate electrons as an electron source. Thus, a predetermined pattern can be displayed on the display portion in response to the electrons. The fact that the filaments or filament sets are alternately powered to induce hot-eletron emanation can reduce the overall power consumption for the vacuum fluorescent displays.

While the invention has been described with reference to various illustrative embodiments, the description is not intended to be construed in a limiting sense. Various modifications of the illustrative embodiments, as well as other embodiments of the invention, will be apparent to those person skilled in the art upon reference to this description. It is therefore contemplated that the appended claims will cover any such modifications or embodiments as may fall within the scope of the invention defined by the following claims and their equivalents.

What is Claimed is:

1. A vacuum fluorescent display, comprising:

a plurality of filaments;

a controller for alternately connecting one of said filaments with a power supply to generate electrons; and a display portion for displaying a pattern in response to said electrons.

2. The vacuum fluorescent display as claimed in claim 1, wherein said controller alternately connects one of said filaments with said power supply in the manner of a scanning operation.

3. The vacuum fluorescent display as claimed in claim 1, further comprising a grid deposed between said filaments and said display portion.

4. The vacuum fluorescent display as claimed in claim 1, wherein said filaments are arranged in parallel.

5. The vacuum fluorescent display as claimed in claim 1, wherein said display portion comprises a plurality of anodes.

6. The vacuum fluorescent display as claimed in claim 5, wherein said anodes are configured with segments.

7. The vacuum fluorescent display as claimed in claim 5, wherein said anodes are configured with dot-matrix.

8. The vacuum fluorescent display as claimed in claim 5, wherein said anodes are configured with pixels.

9. The vacuum fluorescent display as claimed in claim 5, wherein said anodes are coated with fluorescent material.

10. A vacuum fluorescent display, comprising:

a plurality of filament sets;

a controller for alternately connecting one of said filament sets with a power supply to generate electrons; and a display portion for displaying a pattern in response to said electrons.

11. The vacuum fluorescent display as claimed in claim 10, wherein said controller alternately connects one of said filament sets with said power supply in the manner of a scanning operation.

12. The vacuum fluorescent display as claimed in claim 10, wherein each said filament set comprises at lest two filaments.

13. The vacuum fluorescent display as claimed in claim 10, further comprising a grid deposed between said filaments and said display portion.

14. The vacuum fluorescent display as claimed in claim 10, wherein said filaments are arranged in parallel.

15. The vacuum fluorescent display as claimed in claim 10, wherein said display portion comprises a plurality of anodes.

16. The vacuum fluorescent display as claimed in claim 15, wherein said anodes are configured with segments.

17. The vacuum fluorescent display as claimed in claim 15, wherein said anodes are configured with dot-matrix.

18. The vacuum fluorescent display as claimed in claim 15, wherein said anodes are configured with pixels.

19. The vacuum fluorescent display as claimed in claim 15, wherein said anodes are coated with fluorescent material.

* * * * *